US009637306B2

(12) United States Patent
Steinert et al.

(10) Patent No.: US 9,637,306 B2
(45) Date of Patent: May 2, 2017

(54) AIR CARGO CONTAINER COMPRISING AN INTERMEDIATE ELEMENT

(71) Applicant: Deutsche Post AG, Bonn (DE)

(72) Inventors: Frank Steinert, Lohmar (DE); Mark Veasey, Bonn (DE)

(73) Assignee: Deutsche Post AG, Bonn (DE)

( * ) Notice: Subject to any disclaimer, the term of this patent is extended or adjusted under 35 U.S.C. 154(b) by 0 days.

(21) Appl. No.: 14/696,538

(22) Filed: Apr. 27, 2015

(65) Prior Publication Data

US 2015/0307269 A1 Oct. 29, 2015

(30) Foreign Application Priority Data

Apr. 29, 2014 (DE) ..... 10 2014 105 970

(51) Int. Cl.
*B65D 88/14* (2006.01)
*B65D 90/00* (2006.01)
(Continued)

(52) U.S. Cl.
CPC ..... *B65D 88/14* (2013.01); *B65D 88/526* (2013.01); *B65D 90/006* (2013.01);
(Continued)

(58) Field of Classification Search
CPC ..... B65D 90/0066; B65D 90/0053; B65D 2590/005; B65D 88/14; B65D 90/12; B65D 90/08; B65D 90/006; B65D 90/0046
(Continued)

(56) References Cited

U.S. PATENT DOCUMENTS 1,581,689 A * 4/1926 Perin ..... B65D 88/12 220/1.5
3,294,034 A 12/1966 Boderheimer et al.
(Continued)

FOREIGN PATENT DOCUMENTS

AT 507214 A4 3/2010
CN 102239091 A 11/2011
(Continued)

OTHER PUBLICATIONS

Machine Translation of AT507214A4 by Lexis Nexis Total Patent on Oct. 14, 2016.
(Continued)

*Primary Examiner* — Stephen Castellano
(74) *Attorney, Agent, or Firm* — Wooddard, Emhardt, Moriarty, McNett &

(57) ABSTRACT

The object of the invention is an air cargo container (1) comprising a rectangular, planar bottom side (2) for accommodating a transported product (8), a rectangular, planar top side (6), at least four connecting profiles (10) and an least triangular, planar intermediate element (12) made of a flexible material, wherein the connecting profiles (10) each connect one corner (11) of the bottom side (2) and one corner (11) of the top side (6) with one another in order to form sides (3) of the air cargo container (1), a guide device (19) is disposed on each of at least three connecting profiles (10) and/or a guide device (19) is disposed on each of two opposing edges (21) of the bottom side (2) and on at least one edge (21) of the top side (6) or on each of two opposing edges (21) of the top side (6) and on at least one edge (21) of the bottom side (2) such that the guide devices (19) define a plane, and the intermediate element (12) comprises a snap-fitting means (20) at each corner (14), wherein said
(Continued)

snap-fitting means has a variable length and is designed to snap into the guide device (19).

8 Claims, 2 Drawing Sheets

(51) Int. Cl.
*B65D 88/52* (2006.01)
*B65D 90/08* (2006.01)
*B65D 90/12* (2006.01)

(52) U.S. Cl.
CPC ..... *B65D 90/0046* (2013.01); *B65D 90/0053* (2013.01); *B65D 90/0066* (2013.01); *B65D 90/08* (2013.01); *B65D 90/12* (2013.01); *B65D 2590/005* (2013.01)

(58) Field of Classification Search
USPC ..... 410/118, 129, 140; 220/1.5, 529, 554, 220/501, 505
See application file for complete search history.

(56) References Cited

U.S. PATENT DOCUMENTS 3,963,290 A 6/1976 Rennemann
4,124,119 A * 11/1978 Nordstrom ..... B60P 3/08 206/335
5,113,537 A * 5/1992 Turk ..... A45F 3/22 135/90
5,824,995 A * 10/1998 Wise ..... B60P 3/426 219/201
5,941,405 A * 8/1999 Scales ..... B65D 88/14 220/1.5
RE39,444 E * 12/2006 Rene ..... B65D 19/12 220/1.5
8,974,158 B1 * 3/2015 Hatch ..... B60P 7/0876 410/117

FOREIGN PATENT DOCUMENTS

DE 2148067 4/1972
GB 1291756 10/1972

OTHER PUBLICATIONS

Machine Translation of Chinese Office Action in related CN Patent Application No. 201510206288.2 issued Sep. 1, 2016.
Machine Translation of CN102239091A by Lexis Nexis Total Patent on Oct. 19, 2016.
Machine Translation of German Office Action received in related German Application No. 102014105970.0 issued Jul. 28, 2016.

* cited by examiner

AIR CARGO CONTAINER COMPRISING AN INTERMEDIATE ELEMENT

CROSS-REFERENCE TO RELATED APPLICATIONS

This application claims priority of German Application No. 10 2014 105 970.0 filed Apr. 29, 2014, which is hereby incorporated by reference.

BACKGROUND

The invention relates to an air cargo container comprising a rectangular, planar bottom side for accommodating a transported product, a rectangular, planar top side, and at least four connecting profiles.

Diverse embodiments of air cargo containers are known from the prior art and are used, in general, to transport large quantities of parcels, luggage, cargo, packages, or other transportable goods, which are bundled in large units as transported products for transport in aircraft. In technical jargon, air cargo containers are referred to as unit load devices (ULD), and are designed as pallets or containers. A ULD container is typically designed as a closed container made of aluminum sheets having a profiled frame or are made of a combination of an aluminum frame having plastic walls. The products to be transported or conveyed are loaded and unloaded into and out of the ULD container through a closable opening. Given that a plurality of individual transported products are transported in a ULD container by being bundled into units, the overall number of individual parcels to be loaded into and unloaded from the aircraft is reduced, thereby saving time and effort and reducing the number of ground personnel required.

Due to aviation safety requirements, which are generally very strict, ULD containers must be certified for a certain type of aircraft. In this regard, certain container types have been developed, which differ in terms of the dimensions, the volume that can be transported in the container, and the aircraft type for which the container is certified. It is very difficult to make modifications to existing, certified container types, since a new certification process must be carried out for nearly every change. This is also why it is not possible to use just any type of specially modified and/or constructed air cargo containers depending on the particular transport volume and transport weight. In practical applications, however, this results—not infrequently—in situations in which containers that are only partially loaded are transported by aircraft. Such unfortunate situations are made that must worse, however, given that the transport costs are calculated not only according to weight, but also according to the volume that is transported, wherein said volume is based on the volume of the air cargo container and not on the volume of the transported product.

Another problem that results from air cargo containers being only partially filled is that the existing possibilities are insufficient for particularly effectively securing transported products, which are transported in the air cargo container, against damage from sliding or falling over during the flight. In addition, transported products exist that can be stacked on top of one another only under certain conditions, or that absolutely must be separated from other transported products during shipment. Intermediate bases that are fixedly installed in air cargo containers are not an effective solution for this problem, however, since the intermediate bases make it impossible to transport large-volume products.

SUMMARY

Proceeding from the problematic issues mentioned above, the object of the invention is that of providing an air cargo container, which enables the product transported therein to be secured in a flexible and reliable manner, and/or which makes it possible to flexibly and easily segment the transport volume in order to achieve a high packing density. Another object of the invention is that of solving the aforementioned problems.

The object is achieved, according to the invention, by the features of the independent claim. Advantageous embodiments of the invention are indicated in the dependent claims.

According thereto, the object is achieved by an air cargo container comprising a rectangular, planar bottom side for accommodating a transported product, a rectangular, planar top side, at least four connecting profiles and an least triangular, planar intermediate element made of a flexible material, wherein the connecting profiles each connect one corner of the bottom side and one corner of the top side with one another in order to form sides of the air cargo container, a guide device is disposed on each of at least three connecting profiles and/or a guide device is disposed on each of two opposing edges of the bottom side and on at least one edge of the top side or on each of two opposing edges of the top side and on at least one edge of the bottom side such that the guide devices define a plane, and the intermediate element comprises a snap-fitting means at each corner, wherein said snap-fitting means has a variable length and is designed to snap into the guide device.

An essential point of the invention is therefore that of providing a flexible intermediate element, which can be introduced, e.g., in a horizontal or vertical extension, into the air cargo container, which is also referred to in the following as a cargo container or a container, and which can then be initially connected within the cargo container to the cargo container by means of the snap-fitting means and can then be fixed as well as tensioned, due to the variable-length configuration thereof. The intermediate element, which is made of a textile fabric, for example, can therefore be fastened, in a flexible and rapid manner, at the point of an intermediate base and/or partition element, which is fixedly installed in the cargo container, in accordance with a specific requirement, in order to separate, affix the transported product and/or to achieve a high packing density of the transported product. The intermediate element can also be used to subdivide the volume of the interior space of the cargo container, and the intermediate element can be used to secure transported product, which has already been loaded into the cargo container, against sliding during shipment. To this end, the intermediate element is initially snapped into the guide device by means of the snap-fitting means and can then be "tensioned", due to the variable-length configuration thereof, such that the intermediate element can rest against the transported product, having contact therewith.

According to a particularly preferred development, the intermediate element has a quadrangular design, wherein one guide device is disposed on each connecting profile and/or one guide device is disposed on each of two opposing edges of the bottom side and the top side. The intermediate element preferably has a planar extension, which is 1%, 2%, 5%, 10%, 15% or 20% smaller than the planar extension of the bottom side, the top side, and/or a side wall of the container, which is spanned by at least two connecting profiles. Preferably, the top side extends parallel to the bottom side, wherein the connecting profiles each extend perpendicularly to the bottom side and/or to the top side.

By placing the guide device on the connecting profile, it is possible to dispose the intermediate element in a position within the cargo container that extends horizontally or substantially horizontally and to thereby form an intermediate base and/or shelf base within the cargo container. By providing the guide device on an edge of the bottom side or the top side, it is possible to obtain a vertical or substantially vertical extension of the intermediate element relative to the planar extension of the bottom side, in order to thereby obtain, e.g., a partition within the cargo container. The intermediate element can also be disposed, in the snapped-in state, within the cargo container such that the intermediate element extends from the "upper left" to the "lower right". Given that the length of the snap-fitting means can be varied, said snap-fitting means is preferably designed to tension the intermediate element when it is snapped into the guide device by means of the snap-fitting means. This means that the intermediate element, in a relaxed state, can hang down along the extension thereof between two opposite corners, whereas, in the tensioned state, the intermediate element hangs down to a lesser extent or not at all between two opposite corners. After the intermediate element is tensioned, the intermediate element preferably extends in a flat, planar manner between the guide devices.

Very particularly preferably, the guide devices are disposed such that the intermediate element, having been snapped into the guide devices by means of the snap-fitting means, extends in a plane that is parallel or perpendicular to the bottom side. Further preferably, the guide devices are disposed such that the guide devices define a straight or curved plane. According to a further preferred embodiment, the intermediate element is preferably provided with a snap-fitting means at every corner in order to achieve a fastening of the intermediate element with the cargo container that is as stable as possible. In addition, it can be advantageous when the intermediate element can be fastened with the cargo container not only at the corners. According to a preferred development, the intermediate element therefore comprises a variable-length snap-fitting means between two corners, which is designed to be snapped into the guide device. Corresponding thereto, another, corresponding guide device is preferably provided on the cargo container, e.g., preferably on the connecting profile and/or on an edge. Further preferably, a plurality of additional snap-fitting means is provided between two corners, e.g., one every 10 cm or 20 cm along the edge of the intermediate element between two preferably adjacent corners. By providing a plurality of snap-fitting means, it is also possible to control relatively large loads with the intermediate element, said loads being distributed proportionally among the plurality of snap-fitting means toward the cargo container.

Providing the guide rails on the connecting profiles or edges of the bottom side or the top side provides another advantage over the embodiments known from the prior art that have intermediate bases fixedly installed in a cargo container. In contrast to the latter embodiments, in which the forces must be dissipated via the entire side walls, in the proposed embodiment, the forces induced by the intermediate element are dissipated by the bottom side, to which the connecting profiles are connected.

The parts that are used or installed on board a cargo transport aircraft and/or passenger aircraft typically must undergo an expensive and time-consuming certification process in order to obtain approval. According to a particularly preferred embodiment of the invention, the guide device is therefore designed as a "seat track" guide and the snap-fitting means is designed as a "double stud" snap-fitting means for snapping into the "seat track" guide, i.e., according to standards for the approved and certified use on board aircraft that are known to a person skilled in the art. Particularly preferably, the guide device and/or the snap-fitting means are certified for use in an aircraft, e.g., a cargo transport aircraft and/or a passenger aircraft, in particular, e.g., according to AS33601, NAS3610 and/or AS36100. Particularly preferably, the "seat track" guide is designed in combination with a "double stud" snap-fitting means for a load of 44.45 kN/10,000 lbs. Even further preferably, the "double stud" snap-fitting means is designed as a "tie down double stud fitting with link and ring" and a load of 22.2 kN/5,000 lbs. Further preferably, the guide device is made of aluminum, e.g., according to the specification 7075T73511. Even further preferably, the guide device is connected to the air cargo container by screwing, bonding, pressing, and/or riveting.

The embodiment of the guide device and/or the snap-fitting means according to a standard that is certified for aviation is particularly advantageous, since, in this case, no new certification is required for the installation thereof in an air cargo container, which is also certified accordingly. Since the intermediate element can be removed from the air cargo container, i.e., it is not permanently fixedly connected to the air cargo container and cannot be removed, no certification is required for the intermediate element, either. This means that certification is not required for the use of the proposed air cargo container in an aircraft when a guide device and a snap-fitting means, as well as the intermediate element, which is not non-removably connected to the air cargo container, are used that have already been certified for aviation.

According to another preferred embodiment, the guide device on the connecting profile extends between the top side and the bottom side and/or between two connecting profiles on the edge of the bottom side and/or the top side. Further preferably, the guide device is provided along the entire connecting profile or edge and touches the top side and the bottom side or two adjacent connecting profiles. Further preferably, the guide device has a plurality of predefined positions, which are formed, for example, by milled-out sections in the guide device, into which the snap-fitting means can engage. Likewise, it can be provided that the snap-fitting means can snap into the guide device at any position between the beginning and the end of the guide device. As a result, the intermediate element can be provided at various positions within the cargo container, thereby making it possible to vary the level of an intermediate base, which is formed by the intermediate element, relative to the bottom side, and/or to separate differently-sized volumes of the cargo container in the vertical direction by means of the intermediate element. Likewise, a plurality of intermediate elements can be provided, thereby making it possible, for example, to load the cargo container in four different levels by using three intermediate elements. Compared to intermediate elements made of a stiff material, such as aluminum, the proposed solution makes it possible to reduce weight by approximately 50 to 60 kg by using, e.g., three intermediate elements per air cargo container, which substantially reduces the fuel consumption of the aircraft.

In principle, the intermediate element can be made of any type of flexible material. According to a particularly preferred development, however, the intermediate element is made of a textile fabric comprising a plurality of reinforcements that have been introduced into the fabric. Preferably, the reinforcements are arranged periodically and extend along the entire length of the textile fabric. Further preferably, the textile fabric is made of natural fibers, man-made fibers, such as polyester, polyamide, or aramid, or of a mixture of the aforementioned fibers and, very particularly preferably, are fire-retardant or fireproof. Even further preferably, the fabric has a thickness of 2, 3, 5 or 7 mm. Further preferably, the intermediate element is made of a textile fabric, which is certified for use in an aircraft. Even further preferably, the reinforcements are designed as glass fiber rods that are disposed parallel to one another and are inserted or sewn into the fabric. Preferably, the reinforcements are disposed so as to be spaced apart from one another by 5 cm, 10 cm, 15 cm or 20 cm and extend along 80%, 90%, 95% or 100% of the length of the intermediate element. In addition to glass fiber rods, it is also possible to use any other type of reinforcing element. In any case, the stiffness of the intermediate element can be increased by providing reinforcements, thereby enabling the intermediate element to support greater loads.

According to a preferred development, the snap-fitting means has a belt strap and a clamping lock, wherein the belt strap is connected to the intermediate element and is length-adjustable by means of the clamping lock. The belt strap is preferably made of polyester, nylon and/or a material having fire-retardant and/or fireproof properties and, further preferably, has a width of 20 mm, 25 mm or 1 inch. Even further preferably, the belt strap is designed according to the standard JAR 25.853 Appendix F, Part A1 IV. and/or ASNA3573. Very particularly preferably, an opening is formed in a corner region of the intermediate element, through which the belt strap is guided in order to be fastened to the intermediate element. After the snap-fitting means has been snapped into the guide device, the spacing between the opening and the guide device can be easily reduced by means of the clamping lock and, therefore, for example, transported products covered by the intermediate element can be fixed in position. To this end, the clamping lock is further preferably designed such that the belt strap can be fixed in position by means of the clamping lock, e.g., in the manner of a manually operated buckle. It is therefore possible for an operator to easily tension the intermediate element in the cargo container.

In a very particularly preferred embodiment, the cargo container is designed as a unit load device and, further preferably, comprises a closed container made of aluminum sheets having profiled frames, which are formed partially or entirely by the connecting profiles, or made of a combination of aluminum for the frame and plastic for the walls. Even further preferably, the unit load device is designed as an air cargo container of the type "lower deck container" (LD), "upper deck container" (UD) and/or "main deck container" (M), for example according to the types LD1, LD2, LD3, LD6, LD7, LD8, LD9 or LD11, or M1 or M1H, and has, e.g., an internal volume of 4.3 $m^3$ and a slanted design having a height of 163 cm, a base width of 156 cm, a cover width of 201 cm, and a width of 153 cm. Further preferably, the cargo container has at least one wall side, wherein the wall side extends between two adjacent connecting profiles, the top side, and the bottom side. The connecting profiles are preferably made of aluminum and are disposed along an edge between the top side and the bottom side. Likewise, connecting profiles can be provided on the edges of the bottom side and/or the top side, which form an angle of 90° with the connecting profiles of the side walls.

An opening is preferably provided on a front wall side of the cargo container, through which transported products can be loaded into and unloaded out of the cargo container. Preferably, the front side is adjoined by a side wall on each side, wherein each side wall is bounded by two connecting profiles and the top side and the bottom side. Further preferably, a rear side is disposed opposite the front side, said rear side adjoining the two side walls, the top side, and the bottom side. Further preferably, the sides of the cargo container are each designed as flat surfaces, wherein it can also be provided, however, that the rear side has a curved cross-sectional shape, in order to obtain the best possible adaptation to a curved aircraft fuselage. To this end, the cargo container can have a triangular, rounded shape as viewed from the side, wherein the rear side and the top side have a single-piece design as a continuous curve. Embodiments that are pentagonal as viewed from the side are also common, wherein the top side, front side, bottom side, and rear side are disposed at right angles to one another and, in addition, another rear side is formed in an upper or lower rear region, wherein said rear side is slanted relative to the rear side. In such an embodiment that is pentagonal as viewed from the side, three edges of the rear side and the other slanted rear side—on each of which a connecting profile can be disposed—are therefore formed on the container rear side. In this case, when the intermediate element is disposed in the cargo container at a right angle relative to the extension of the bottom side, said intermediate element can have five corners, each of which is provided with a snap-fitting means.

The invention is described in greater detail in the following with reference to the attached drawings and on the basis of a preferred embodiment.

DETAILED DESCRIPTION OF THE DRAWINGS

Figure 1:
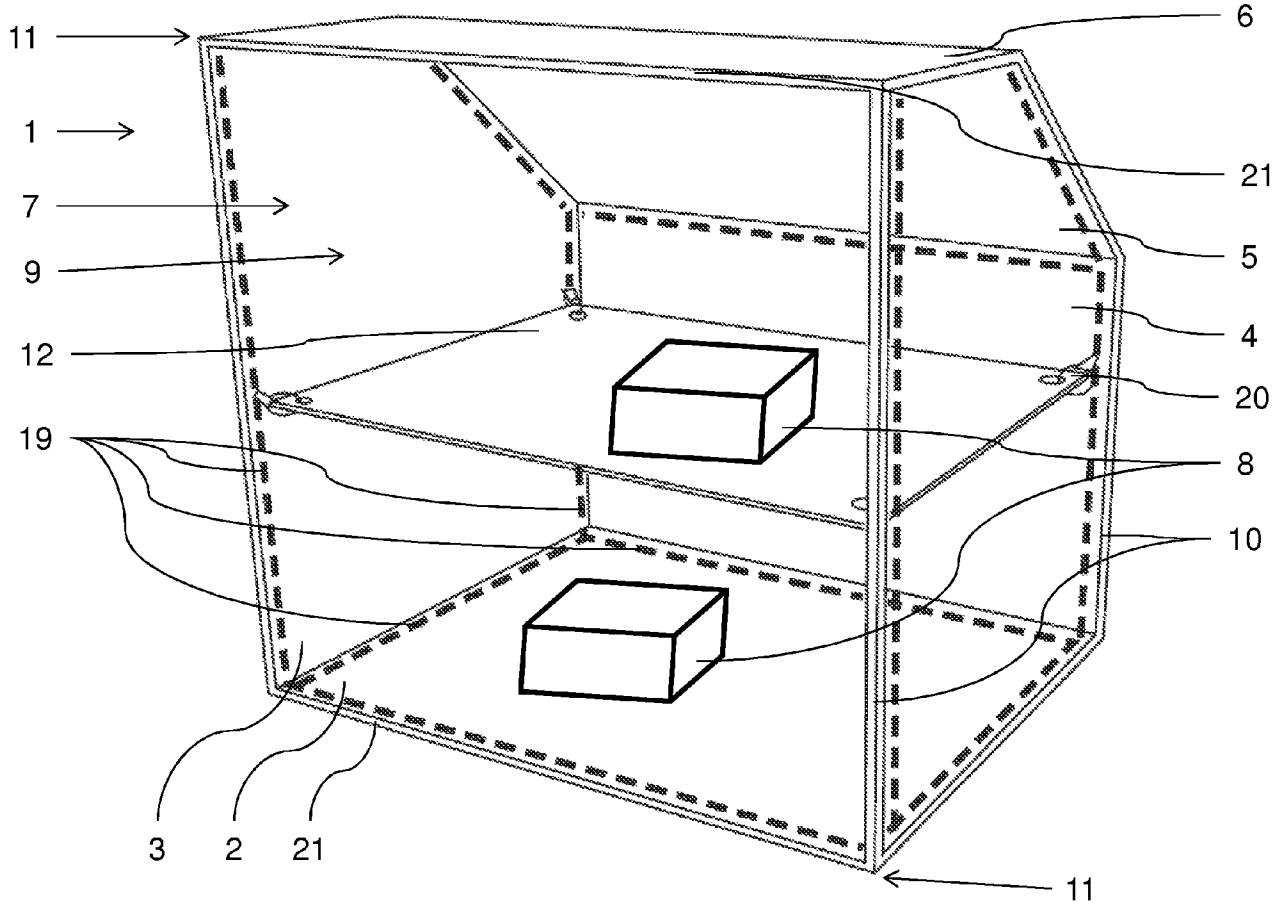
FIG. 1 shows a perspective, schematic view of an air cargo container comprising an intermediate element according to a preferred embodiment of the invention.

FIG. 1 shows a perspective, schematic view of an air cargo container 1 according to a preferred embodiment of the invention. The air cargo container 1 has a bottom side 2, two side walls 3, a rear wall 4, a slanted rear wall 5, and a top side 6. In the present case, the front side 7 is designed as an opening, through which freight 8 can be loaded and unloaded into and out of a container interior 9, which is formed by a bottom side 2, side walls 3, rear walls 4, 5, and a top side 6. The air cargo container 1 is made of an aluminum sheet, wherein the right side wall 3 is made transparent in FIG. 1. Whereas the bottom side 2, the side wall 3, the rear wall 4, and the top side 6 are each disposed at a right angle relative to one another, the slanted rear wall 5 is disposed at an angle of 135° relative to both the top side 6 and the rear wall 4, although said slanted rear wall likewise forms a right angle with the side walls 3. The air cargo container 1 therefore has a pentagonal shape as viewed from the side, i.e., as viewed from the side wall 3.

The edges of the side walls 3 are formed by aluminum connecting profiles 10, which extend between the bottom side 2 and the top side 6. Whereas the two connecting profiles 10 disposed on the front side 7 extend parallel to one another, from a corner 11 of the top side 6 to a corner 11 of the bottom side 2 in each case, the two connecting profiles 10 on the side wall 3 extend parallel to one another in the region of the rear wall 4, but extend at an angle of 45° relative to one another in the region in the slanted rear wall 5. The freight 8 can be loaded onto the bottom side 2, as shown in FIG. 1.

Figure 2:
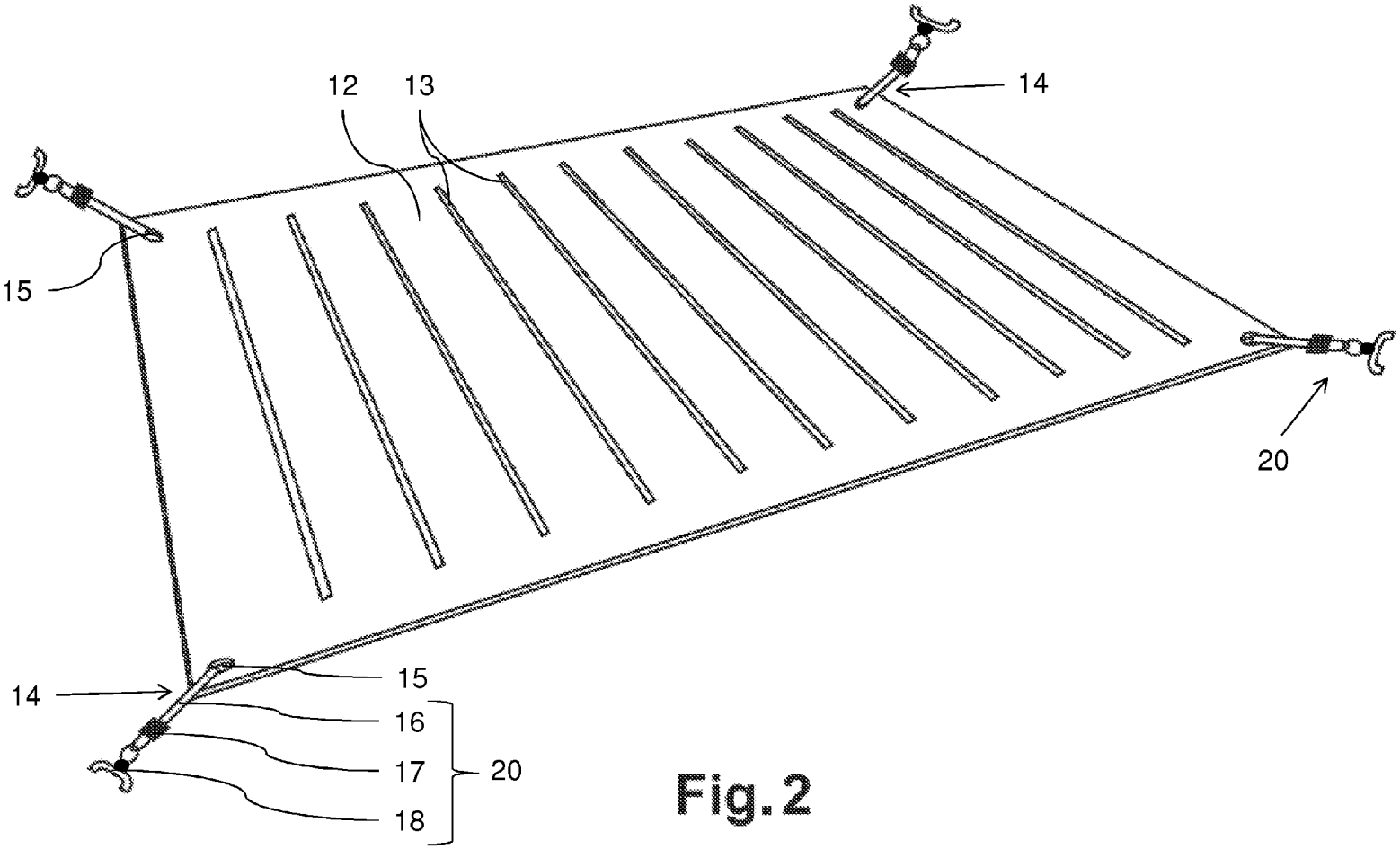
FIG. 2 shows a perspective, schematic view of the intermediate element according to the preferred embodiment of the invention.

According to the invention, an intermediate element 12 is then provided, which is depicted in detail in FIG. 2, and which can be fastened in the container interior 9 in the manner of an intermediate base, which is depicted in the horizontal extension thereof in FIG. 1. As an alternative, the intermediate element 12 can also be fastened within the container interior 9 in the manner of a partition, extending parallel to the side wall 3. The intermediate element 12 is made of a flexible material, e.g., a non-combustible textile fabric in the present case, which is reinforced with a plurality of glass fiber rods, as reinforcements 13, which are disposed parallel to one another and are sewn into the textile fabric, as shown in FIG. 2. The reinforcements 13 are disposed so as to be spaced apart by 10 cm, and extend along 90% of the length of the intermediate element 12.

Openings 15 are sewn in at the four corners of the intermediate element 14, through which said openings a belt strap 16 is guided. The belt strap 16 is made of a polyester material having a fire-retardant property and a width of 2.5 mm and is designed according to the aviation standards JAR 25.853 Appendix F, Part A1 IV. and ASNA3573. Furthermore, a manually operated clamping lock 17 is provided, through which the belt strap 16 is guided such that the length of the spacing between the clamping lock 17 and the opening 15 can be adjusted by means of the clamping lock 17, i.e., the intermediate element 12 can be tensioned. Whereas the clamping lock 17 is connected to the belt strap 16 on one side, the clamping lock 17 is connected, on the other side, to a so-called "double stud", which is certified according to the aviation standard AS33601, NAS3610 and/or AS36100, i.e., to a so-called "tie down double stud fitting with link and ring" 18 in the present case. The belt strap 16, the clamping lock 17, and the double stud 18 form a length-adjustable snap-fitting means 20, which is designed to snap into a guide device 19.

The guide device 19 is designed as a "seat track" guide according to the aviation standard AS33601, NAS3610 and/or AS36100 and, referring back to FIG. 1, is fastened in the container interior 9 of the air cargo container 1. Specifically, guide devices 19 are riveted to the corresponding sides 2, 3, 4, 5 and 6, which is depicted in the present case as dashed lines, in the container interior 9, in each case along the entire length of the connecting profiles 10 and the edges 21 of the top side 6, the bottom side 2, and the slanted rear wall 5. The intermediate element 12, which, in the present case, is rectangular and has a planar extension that is 10% smaller than the bottom side 2, can be snapped into a guide device 19 in each case by means of the snap-fitting means 20 provided on every corner 14 of the intermediate element 12, wherein said guide device is shown in the snapped-in state in FIG. 1.

After the four snap-fitting means 12 are snapped into the four guide devices 19, a user can tighten the belt strap 16 and fix it in position by means of the clamping lock 17 such that the intermediate element 12 can be transferred from an initial "slack" state into a state that is as flat as possible, as shown in FIG. 1. It is then possible to place freight 8, such as parcels, packages, or other transportable products, onto the intermediate element 12, which has a thickness of 2-3 mm, for example. Since the air cargo container 1, which is shown here and is designed as a unit load device, has a height of 118 inches and a width of 125 inches and a depth along the bottom side 2 of 96 inches, it is also possible to dispose a plurality of intermediate elements 12 above one another and spaced apart from one another in the air cargo container 1.

It is also possible, in a variant that is not shown, to fasten the intermediate element 12, as a partition element, in the container interior 9 of the air cargo container 1. In this variant, the intermediate element 12 has a pentagonal shape, which corresponds to the pentagonal shape of the side wall 3, wherein a snap-fitting means 19 is provided at every corner. It is also possible for the intermediate element 12 to have a triangular shape. Finally, it is also possible to first cover freight 8 that is present on the bottom side 2, for example, with an intermediate element 12, but to subsequently not snap in the intermediate element 12 at a level of the guide device 19 that corresponds to the level of the freight 8, but rather to snap said intermediate element into the guide device 19 closer to the bottom side 2. As a result, the freight 8 can first be wrapped and fixed against sliding by tightening the belt strap 16 by means of the clamping lock 17. Particularly advantageously, the flexible intermediate element 12 can be used to secure hazardous freight 8 against sliding within the container interior 9, or to separate freight 8, such as a cold box, from other freight 8.

As another alternative, freight 8 can also be set down on the bottom side 2, next to the left side wall 3, and the intermediate element 12 can be snapped into the guide device 19 at the level of the freight 8 on the left side thereof by means of the snap-fitting means 20, while, on the right, opposite side of the intermediate element 12, the snap-fitting means 20 is snapped into the guide device 19 on the right side wall 3 at the level of the bottom side 2. It is also possible to provide further snap-fitting means 20 between two corners 14 of the intermediate element 12, for which further guide devices 19 are provided in the container interior 9 in a corresponding manner.

In the end, the proposed air cargo container 1 makes it possible to obtain a substantially greater packing density of freight 8, wherein the intermediate element 12 makes it possible to secure the freight 8 in the container interior 9 and to separate different pieces of freight 8 in the container interior 9, e.g., according to the type of freight 8 or according to the destination or recipient of the freight 8. Moreover, a substantial weight reduction is achieved due to the flexible design of the intermediate element 12 made of a textile fabric having man-made fibers as compared to a rigid intermediate base made of aluminum. Finally, since the proposed solution, in terms of the guide devices 19 that are intended to be connected to the air cargo container 1, can be made from components that have already been certified for aviation, the proposed solution can be used in aircraft without the need for expensive and time-consuming certification.

LIST OF REFERENCE SIGNS air cargo container 1
bottom side 2
side wall, side 3
rear wall 4
slanted rear wall 5
top side 6
front side 7
freight, transported product 8
container interior 9 connecting profile 10
corner of the bottom side, corner of the top side 11
intermediate element 12
reinforcement 13
corner of the intermediate element 14
opening 15
belt strap 16
clamping lock 17
double stud 18
guide device 19
snap-fitting means 20
edge 21

The invention claimed is:

1. An air cargo container comprising a rectangular, planar bottom side for accommodating a transported product, a rectangular, planar top side, at least four connecting profiles and a planar quadrangular intermediate element made of a flexible material, wherein the connecting profiles each connect one corner of the bottom side and one corner of the top side with one another in order to form sides of the air cargo container, a guide device is disposed on each of at least three connecting profiles and/or a guide device is disposed on each of two opposing edges of the bottom side and on at least one edge of the top side or on each of two opposing edges of the top side and on at least one edge of the bottom side, wherein one guide device is disposed on each connecting profile and/or one guide device is disposed on each of two opposing edges of the bottom side and the to side, wherein the guide device extends on the connecting profile between the to side and the bottom side and/or between two connecting profiles on the edge of the bottom side and/or the top side such that the guide devices define a plane, the intermediate element comprises a snap-fitting means at each corner, wherein the intermediate element is made of a textile fabric comprising a plurality of reinforcements that have been introduced into the fabric, wherein said snap-fitting means has a variable length and is designed to snap into the guide device, wherein the guide devices are disposed such that the intermediate element, having been snapped into the guide devices by means of the snap-fitting means, extends in a plane that is parallel or perpendicular to the bottom side, wherein the guide device is designed as a "seat track" guide and the snap-fitting means is designed as a "double stud" snap-fitting means for snapping into the "seat track" guide, and the cargo container is designed as a unit load device.

2. The cargo container according to claim 1, wherein the reinforcements are designed as glass fiber rods that are disposed parallel to one another and are sewn into the fabric.

3. The cargo container according to claim 2, wherein the snap-fitting means has a belt strap and a clamping lock, wherein the belt strap is connected to the intermediate element and is length-adjustable by means of the clamping lock.

4. The cargo container according to claim 3, comprising at least one side wall, wherein the side wall extends between two adjacent connecting profiles, the top side, and the bottom side.

5. The cargo container according to claim 1, wherein the snap-fitting means has a belt strap and a clamping lock, wherein the belt strap is connected to the intermediate element and is length-adjustable by means of the clamping lock.

6. The cargo container according to claim 1, comprising at least one side wall, wherein the side wall extends between two adjacent connecting profiles, the top side, and the bottom side.

7. The cargo container according to claim 1, wherein the cargo container is a closed container comprising aluminum.

8. The cargo container according to claim 1, wherein the unit load device is selected from the group consisting of LD1, LD2, LD3, LD6, LD7, LD8, LD9, LD11, M1 and M1H.

* * * * *